United States Patent [19]

Shepherd

[11] 4,187,975

[45] Feb. 12, 1980

[54] COMBINATION SLOTTED PARTITION SPACER

[75] Inventor: Charles J. Shepherd, Holland, Mich.

[73] Assignee: W. J. Bradford Paper Company, Holland City, Mich.

[21] Appl. No.: 917,525

[22] Filed: Jun. 21, 1978

[51] Int. Cl.[2] ..... B65D 1/36; B65D 5/48; B65D 81/00

[52] U.S. Cl. ..... 229/15; 217/31

[58] Field of Search ..... 229/15, 42; 217/30, 217/31, 32, 33, 21, 22

[56] References Cited

U.S. PATENT DOCUMENTS

| | | | |
|---|---|---|---|
| 390,735 | 10/1888 | Wieland | 217/31 |
| 1,713,682 | 5/1929 | Walter | 229/15 |
| 1,880,897 | 10/1932 | Drewsen | 229/15 UX |
| 1,917,886 | 7/1933 | Hogan | 229/15 X |
| 1,976,530 | 10/1934 | Verhoven | 229/15 X |
| 2,840,293 | 6/1958 | Paige | 229/15 |
| 3,371,840 | 3/1968 | Schlager et al. | 229/15 |
| 3,549,007 | 12/1970 | Charrier | 229/15 X |
| 3,767,106 | 10/1973 | Morgan | 229/15 X |
| 3,837,560 | 9/1974 | Kuchuris | 229/15 |

*Primary Examiner*—Davis T. Moorhead
*Attorney, Agent, or Firm*—Wood, Herron & Evans

[57] ABSTRACT

A combination corrugated and fiberboard partition spacer in which the partitions are all slotted from one edge and in which the slots of longitudinal and transverse partitions are reversely oriented and colinearly aligned to form a multiple cell divider or spacer. The novelty of this combination corrugated and fiberboard partition resides in the provision of extra wide slots at selected slot sites of an otherwise all fiberboard partition spacer and the insertion in those extra wide slots of slotted corrugated partitions.

3 Claims, 7 Drawing Figures

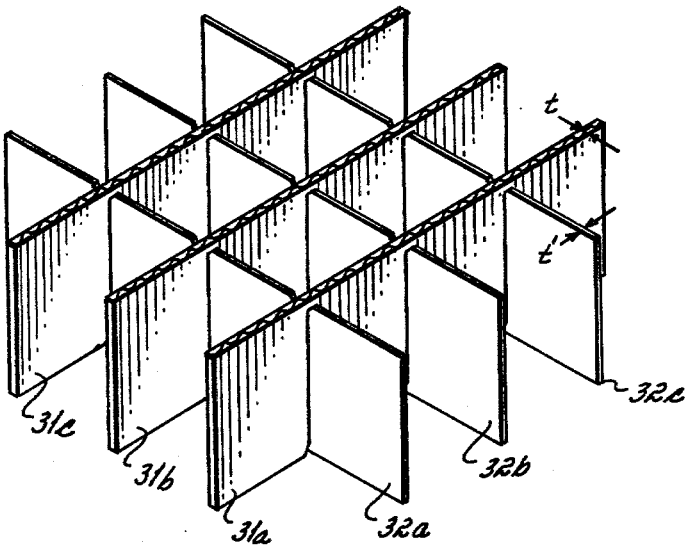
Fig. 5
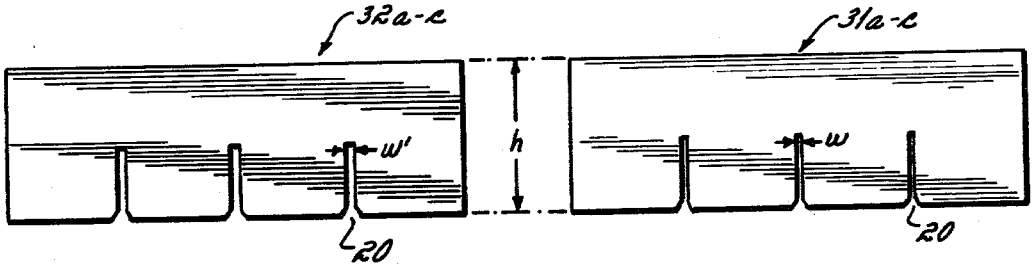
Fig. 5A
Fig. 5B

COMBINATION SLOTTED PARTITION SPACER

This invention relates to slotted partitions and particularly to slotted partitions of the type commonly used as interior protective structures within shipping packages or containers. These structures are slotted so that when the slots of two or more partitions are reversely oriented and assembled, the partitions are interlocked to form cells within which articles such as eggs, bottles, cookies, candies, electronic components, etc. may be packaged.

Although slotted partitions may and are commonly made from any number of different materials, as for example wood, metal, or solid and foamed plastic, they are most commonly made from, and this invention is concerned only with slotted partitions made from paper, either in the form of solid fiberboard (sometimes called chipboard) or corrugated board. Specifically, this invention is concerned with spacers made from a combination of slotted partitions, some of which are made from fiberboard and some of which are made from corrugated board.

Traditionally, slotted partitions have either been made from all solid fiberboard or all corrugated board and the machines for effecting the automatic assembly of the partitions have been made to assemble all of one or the other, but not the combination. The choice as to which type of partition was used was usually a function of the desired protective qualities, tear resistance and vertical compression strength required. If less protection or rigidity was required, less expensive fiberboard was generally chosen, and if greater protection or rigidity was necessary, the more expensive and space consuming, corrugated board was selected. In many applications though, the product was over-protected and over-packaged because inexpensive fiberboard lacked the requisite vertical rigidity and compressive strength but corrugated board far exceeded the required properties, and in the process not only drove the cost up unnecessarily, but also dictated that a larger carton be used and increased shipping expenses incurred. Consequently, there has been a long standing and unfilled need for a spacer which had the packing density and cost properties of fiberboard but increased vertical ridigity and strength over the all fiberboard partition now available.

I have discovered and this invention is predicated upon the concept of increasing the self-standing vertical rigidity and compressive strength of slotted fiberboard partitions by locating corrugated slotted partitions at selected sites throughout the spacer formed by the assembled partitions.

Specifically, I have found that if selected slots of the fiberboard partition are made wider than the remainder of the slots and if corrugated partitions are inserted into those wider slots, the resulting spacer often has all of the vertical rigidity and compressive strength required and makes the resulting combination or hybird spacer preferable to an all corrugated spacer. The insertion of corrugated longitudinal and transverse partitions at selected slot sites of an otherwise all fiberboard partition spacer results in a hybrid product that generally has very nearly all of the vertical rigidity and compressive strength of an all corrugated spacer but without the increased cost of an all corrugated spacer and with greater packing density than an all corrugated board spacer.

In one preferred embodiment two intersecting corrugated slotted partitions are assembled into an otherwise all fiberboard partition spacer. These corrugated partitions are inserted into wider slots provided at the center of the fiber partitions so that the corrugated partitions intersect at the center of the combination corrugated and fiberboard slotted partition spacer. The substitution of these corrugated partitions at the center of the otherwise all fiberboard spacer has been found to greatly increase the stacking strength of the spacer or of a carton containing the assembled conbination spacer.

In a second preferred embodiment four intersecting corrugated slotted partitions are assembled into an otherwise all fiberboard partition. In this embodiment these four corrugated partitions are inserted into wider slots provided near the ends of the partitions so that the corrugated partitions extend about the periphery of the assembled combination corrugated and fiberboard partition spacer. This embodiment is particularly applicable to spacers contained within corrugated cartons which overhang a standard size pallet when the cartons are stacked for shipping. The unitized pallet load is greatly strengthened by substituting a ring of corrugated partition strips within the design of the partition so that the corrugated partition strip is located within the vertical plane of the outside edge of the pallet.

A third preferred embodiment of my invention utilizes all corrugated partitions extending in one direction. In this embodiment either the transverse partitions or the longitudinal partitions are all manufactured from corrugated paper and the partitions which extend in the other direction are manufactured from fiberboard. In this embodiment the fiberboard partitions have wide slots for the reception of the corrugated partitions and the corrugated partitions have slots for the reception of the fiber partitions. The particular advantage of this embodiment of combination corrugated and fiberboard partitions is that it lends itself to automatic assembly on conventional partition assembly machines while still retaining much of the vertical rigidity and compressive strength of all corrugated partition spacers and some of the packing density and cost advantages of all fiberboard partition spacers.

The primary advantage of combining fiberboard and corrugated partitions according to the practice of this invention is that it greatly increases the vertical rigidity and compressive strength of an all fiberboard partition spacer while at the same time effecting a substantial cost savings over an all corrugated partition spacer. Additionally, this combination spacer preserves most of the packing density advantages of an all fiberboard partition spacer. Consequently, the combination of slotted corrugated and fiberboard partitions of this invention in many applications exhibit all of the advantages of all corrugated partition spacers but without the usual disadvantages which attend a choice of corrugated partitions over fiberboard ones.

These and other objects and advantages of this invention will be readily apparent from the following description of the drawings in which:

FIG. 3 is a perspective view of a third embodiment of slotted partition spacer incorporating the invention of this application.

FIG. 3A is a side elevational view of a transverse slotted partition utilized in the spacer of FIG. 3.

FIG. 3B is a front elevational view of a longitudinally extending spacer utilized in the embodiment illustrated in FIG. 3.

Figure 1:
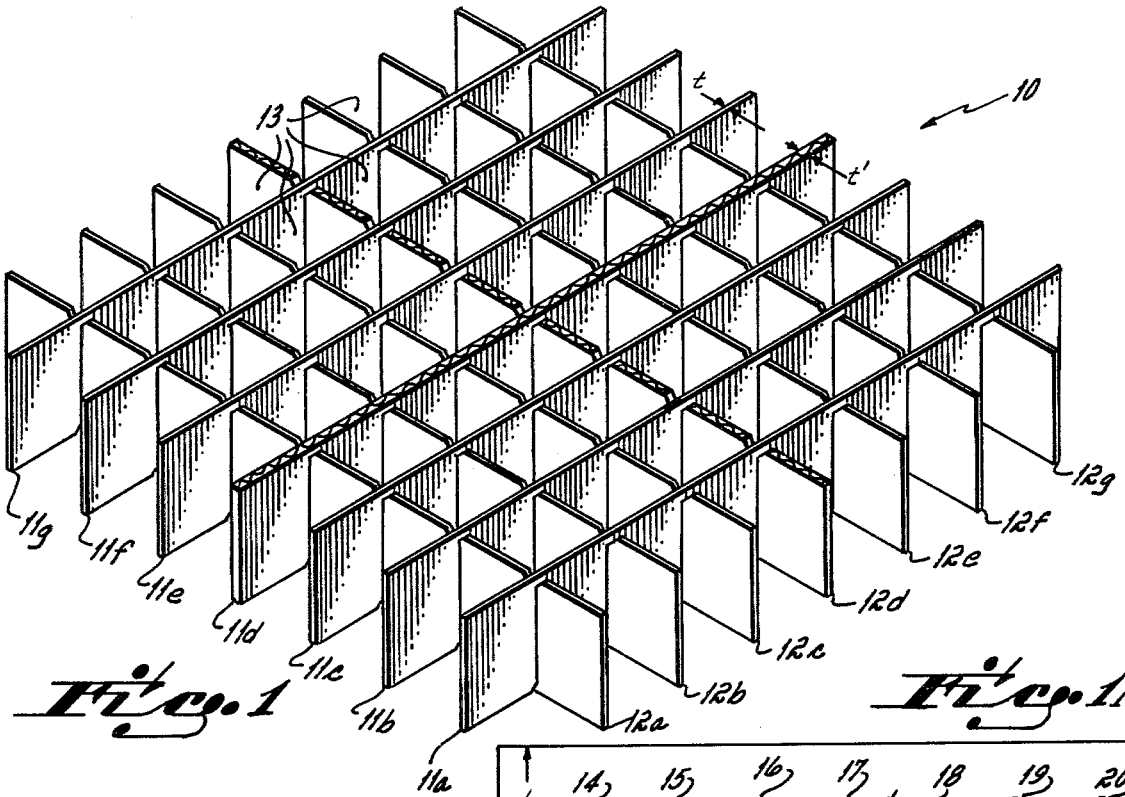
FIG. 1 is a perspective view of a slotted partition spacer incorporating the invention of this application.

Referring first to FIG. 1, there is illustrated a slotted partition spacer 10 comprising intersecting longitudinally extending slotted partitions 11*a*–11*g* and transversely extending slotted partitions 12*a*–12*g*. These slotted partitions are all made from fiberboard (sometimes referred to as chipboard) except for the partitions 11*d* and 12*d* which are made from corrugated board. When viewed in side or front elevation, these partitions 11*a*–11*g* and 12*a*–12*g* whether constructed from fiberboard or corrugated board are all identical as illustrated in FIG. 1A.

The only difference between the partitions is in the different material from which the partitions are manufactured, fiberboard v. corrugated board, and the resulting difference in thickness t v. t′ of the two materials. Of course, the lengths and number of slots in the longitudinal and transverse partitions often differ to accommodate differing configurations of cells 13. Generally the fiberboard partitions are of substantially less thickness t than the corrugated board t′ but both vary in thickness from one application to another. The corrugated board though is generally on the order of three to five times as thick as the fiberboard. These variables are all functions of the material to be packaged within the cells 13 of the assembled spacer and the need for the product being packaged to be protected against either vertical or horizontal compressive forces.

In general, fiberboard partitions cost substantially less than corrugated partitions and occupy less space in the assembled container but corrugated partitions give greater protection to the packaged product because of their great compressive strength and crush resistance. Additionally, the corrugated partitions are less subject to bending or distortion and consequently lend themselves to insertion of product into the cells in applications where the cells are of such great height that the tops of fiberboard partitions bend and flex out of the vertical plane.

Figure 1A:
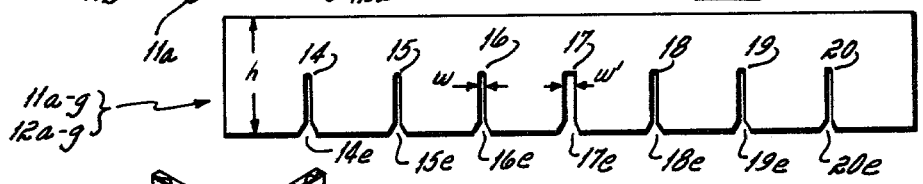
FIG. 1A is a front elevational view of one partition utilized in assembly of the spacer illustrated in FIG. 1.

As may be seen in FIG. 1A, each of the partitions 11*a*–11*g* and 12*a*–12*g* have slots extending upwardly for approximately one-half the height h of the partition. These slots very in width w, w′, the centermost slot 17 being wider than the other slots 14–16 and 18–20. The wider slots 17 receive the corrugated board while the narrow slots receive the fiberboard when the partitions are assembled. Each of the slots 14–20 has a V-shaped lead-in entry 14*e*–20*e* so that the entry and slot together form a Y to facilitate either hand or automatic assembly of the partitions. Of course it is within the scope of this invention to use conventional rectangular shaped slots rather than and as a substitute for the Y shaped slots.

To assemble the partitions 11*a*–11*g* and 12*a*–12*g* the longitudinally extended partitions are positioned with their slots extending downwardly and opposite the upwardly extending slots of the transversely extending partitions 12*a*–12*f*. The slots are then interfitted to form the assembled spacer illustrated in FIG. 1 in which the corrugated partitions 11*d* and 12*d* are located so that they intersect at the center of the assembled spacer when the spacer is viewed in top plan.

The advantage of the spacer illustrated in FIG. 1A is that the centermost corrugated partitions 11*d* and 12*d* lend vertical strength to the assembled spacer and to a container within which the spacer is located. The increased vertical strength imparted by the corrugated partition arranged in this configuration is of particular advantage in a carton when that carton is stacked upon a similarly configured and oriented carton. The stacked cartons are greatly strengthened against crushing by locating the corrugated slotted partitions centrally of the spacers at the location of greatest weakness of the stacked cartons.

Figure 2:
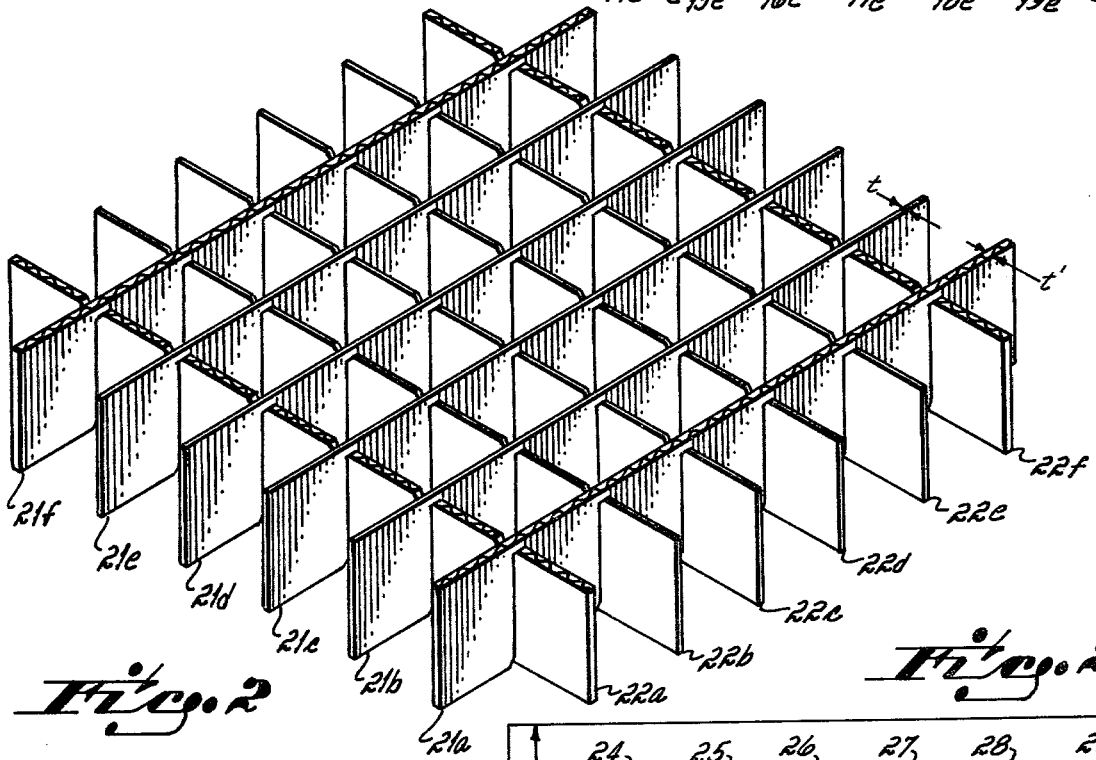
FIG. 2 is a perspective view of a second embodiment of slotted partition spacer incorporating the invention of this application.
Figure 2A:
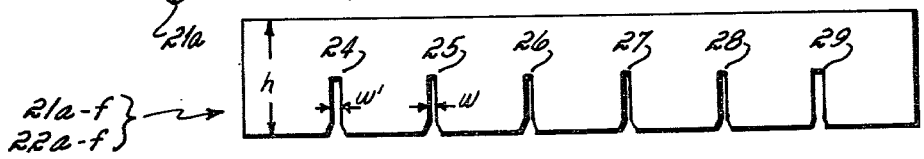
FIG. 2A is a front elevational view of one slotted partition utilized in the spacer of FIG. 2.

Referring now to FIG. 2, there is illustrated a second preferred embodiment of a slotted partition spacer incorporating the invention of this application. In this embodiment the number of longitudinal partitions 21*a*–21*f* equals the number of transverse partitions 22*a*–22*f* so that the spacers are all identical when viewed in either front or side elevation. One such spacer is illustrated in FIG. 2A.

In this embodiment four corrugated slotted partitions are utilized in the otherwise all fiberboard slotted partition space, and these four are located about the periphery of the spacer as the spacer is viewed in top plan. To accommodate these four corrugated partitions, the centermost slots 25, 21, 27 and 28 of each partition 21*a*–21*f* and 22*a*–22*f* are narrower than the endmost slots 24 and 29 which receive the fiberboard partitions.

As in the case of the modification of FIG. 1, the slotted partitions are assembled by orienting all of the longitudinally extending partitions 21*a*–21*f* with the slots facing downwardly and the transverse partitions 22*a*–22*f* with the slots facing upwardly. The slots are then interfitted until the slot of one longitudinal partition is colinear with the slot of a transverse partition. In practice, all of the fiberboard partitions 22*b, c, d* and *e* are assembled with all of the fiberboard longitudinal partitions 21*b, c, d,* and *e,* either automatically by machine or by hand. As a last step in the assembly process the corrugated partitions 22*a* and 22*f* and 21*a* and 21*f* are inserted into the otherwise completed spacer.

The advantage of the spacer illustrated in FIG. 2 is that the outermost corrugated partitions lend vertical strength to the assembled spacer and to a container within which the spacer is located. The increased vertical strength imparted by the corrugated partitions arranged in this configuration is of particular advantage in a carton which overhangs a standard size pallet. The unitized pallet load is greatly strengthened against crushing by locating the ring of corrugated slotted partitions about the periphery of the spacer but within the vertical plane of the outside edge of the pallet.

Referring now to FIG. 3 there is illustrated still a third preferred embodiment of the invention. In this embodiment all of the longitudinally extending spacers 31*a, b* and *c* are made from corrugated paperboard and the transverse partitions 32*a, b* and *c* are made from fiberboard. Consequently, the transverse partitions all have wide slots w′ relative to the narrower slots w of the longitudinal spacers 31*a, b* and *c.* The primary advantage of this spacer over that disclosed in FIGS. 1 and 2 is that it may be more easily machine assembled on conventional assembly machinery because of the identical orientation of all of the corrugated partitions and of the fiberboard partitions.

The primary advantage of all of the three different embodiments disclosed hereinabove over all fiberboard slotted partition spacers or all corrugated board slotted partition spacers results from the lesser cost of fiberboard relative to corrugated board and the lesser space required for a fiberboard partition vis-a-vis corrugated partitions. In general, an all fiberboard partition effects between 10% and 25% savings over an all corrugated slotted partition spacer. Corrugated paperboard is generally more expensive than fiberboard so that this invention which uses a combination of fiberboard and corrugated board effects a savings in total board used and in the average cost per given area of the board over a spacer which is made from all corrugated board partitions.

As an alternative to forming wide slots in the partitions for the reception of corrugated partitions and narrow slots for the reception of fiberboard partitions, we have found through practice and experimentation that assembly (whether manual or mechanized) is greatly expedited and facilitated if all the slots in the corrugated partitions, including those for reception of the fiberboard partitions, are of a width w′ sufficient to receive corrugated partitions. The reason for this increased width slot w′ in the corrugated partitions for the reception of fiberboard partitions is that the fiberboard partitions or strips do not assemble well into the narrow slots w even though the narrow slots are slightly wider than the thickness t of the fiberboard partitions. The increased width w′ for all of the slots in the corrugated partition solves this assembly problem.

I have throughout this application used the term "fiberboard" to describe what is sometimes described in the trade as chipboard, newsboard, single or double lined chipboard, solid kraftboard, laminated board and solid fiberboard. As so used the term "fiberboard" is intended to distinguish from corrugated board which is generally at least three ply in thickness and which has at least two planar sheets of paper between which there is sandwiched a corrugated or wave shaped sheet of paper. In other words, as used herein "fiberboard" is intended to be generic and to encompass all paperboard or fiberboard or chipboard products other than corrugated board or paper.

While I have described three different embodiments of my invention, persons skilled in the art will appreciate other changes and modifications which may be made without departing from the spirit of my invention. Therefore, I do not intend to be limited except by the scope of the following appended claims.

Having described my invention, I claim:

1. A multi-cell spacer for maintaining the spacing and separation of articles contained within cells of the spacer, said spacer comprising a first set of identical, planar, generally rectangular partitions arranged in parallel spacial relationship, each of said partitions having parallel slots extending inwardly from one side edge, a second set of identical, generally planar, rectangular partitions arranged in parallel spacial relationship, each of said partitions of said second set having parallel slots extending inward from a side edge opposite the one side edge of the partitions of said first set, the partitions of said first set being perpendicular to the partitions of said second set when said partitions are assembled with said slots of the partitions of the first set interfitted and colinear with the slots of the partitions of said second set, and at least one of said partitions being constructed of multiple ply corrugated board and the remainder of said partitions being constructed of non-corrugated fiberboard, said corrugated partition being located at a preselected site within the assembled spacer such that it increases the vertical strength and crush resistance of the resulting combination fiberboard and corrugated board spacer.

2. A multi-cell spacer for maintaining the spacing and separation of articles contained within the cells of the spacer, said spacer comprising a first set of identical, planar, generally rectangular partitions arranged in parallel spacial relationship, each of said partitions having parallel slots extending inwardly from one side edge, a second set of identical, generally planar, rectangular partitions arranged in parallel spacial relationship, each of said partitions of said second set having parallel slots extending inward from a side edge opposite the one side edge of the partitions of said first set, the partitions of said first set being perpendicular to the partitions of said second set when said partitions are assembled with said slots of the partitions of the first set interfitted and colinear with the slots of the partitions of said second set, each one of said slots of said partitions being of a single width but at least one of said partitions having slots of increased width relative to other slots of said partitions, and at least one of said partitions being constructed of multiple ply corrugated board and the remainder of said partitions being constructed of non-corrugated fiberboard, said corrugated partitions being located within the wider slots of said partitions.

3. A multi-cell spacer for maintaining the spacing and separation of articles contained within cells of the spacer, said spacer comprising a first set of identical, planar, generally rectangular partitions arranged in parallel spacial relationship, each of said partitions having parallel slots extending inwardly from one side edge, a second set of identical, generally planar, rectangular partitions arranged in parallel spacial relationship, each of said partitions of said second set having parallel slots extending inwardly from a side edge opposite the one side edge of the partitions of said first set, the partitions of said first set being perpendicular to the partitions of said first set when said partitions are assembled with said slots of the partitions of the first set interfitted and colinear with the slots of the partitions of said second set, each of said slots of said partitions being of a single width but varying in width from one slot to another within selected ones of said partitions such that there are least two different width slots within said selected ones of said partitions, and at least two of said partitions being constructed of multiple ply corrugated board and the remainder of said partitions being constructed of non-corrugated, single ply fiberboard, said corrugated partitions being located within the wider slots of said selected ones of said partitions.

* * * * *